US007070546B1

(12) United States Patent
Grasso

(10) Patent No.: US 7,070,546 B1
(45) Date of Patent: Jul. 4, 2006

(54) EXERCISE APPARATUS INCLUDING MULTIPLE FUNCTION ASPECTS AND SMALL FOOTPRINT

(76) Inventor: Joseph Grasso, 5156 Stevens Creek Blvd., San Jose, CA (US) 95129

( * ) Notice: Subject to any disclaimer, the term of this patent is extended or adjusted under 35 U.S.C. 154(b) by 415 days.

(21) Appl. No.: 10/190,196

(22) Filed: Jul. 5, 2002

(51) Int. Cl.
*A63B 21/062* (2006.01)

(52) U.S. Cl. ..... 482/103; 482/94; 482/104; 482/138; 482/145

(58) Field of Classification Search ..... 482/72, 482/93, 94, 98–104, 138, 145; D21/673–675, D21/686, 690, 691
See application file for complete search history.

(56) References Cited

U.S. PATENT DOCUMENTS

| | | | |
|---|---|---|---|
| 3,573,865 | A | 4/1971 | Annas |
| 3,620,210 | A | 11/1971 | Annas et al. |
| 3,708,166 | A | 1/1973 | Annas |
| 3,843,118 | A | 10/1974 | Annas et al. |
| D239,301 | S | 3/1976 | Clarke |
| D239,302 | S | 3/1976 | Clarke |
| D239,303 | S | 3/1976 | Clarke |
| D239,306 | S | 3/1976 | Clarke |
| D239,398 | S | 3/1976 | Clarke |
| D239,399 | S | 3/1976 | Clarke |
| D239,641 | S | 4/1976 | Clarke |
| D239,642 | S | 4/1976 | Clarke |
| D239,643 | S | 4/1976 | Clarke |
| 4,093,213 | A | 6/1978 | Coker et al. |
| 4,357,011 | A | 11/1982 | Voris |
| 4,358,105 | A | 11/1982 | Sweeney, Jr. |
| 4,358,108 | A | 11/1982 | Voris |
| RE31,113 | E | 12/1982 | Coker et al. |

(Continued)

FOREIGN PATENT DOCUMENTS

FR 2561528 A1 * 9/1985

(Continued)

OTHER PUBLICATIONS

Bodybuilder'Discount Outlet, Multi-Press Rack #MPR-80, 1995 summer catalog, p. 10.*

(Continued)

*Primary Examiner*—Stephen R. Crow
*Assistant Examiner*—Victor K. Hwang
(74) *Attorney, Agent, or Firm*—Jones,Tullar&Cooper,P.C.; John J. Leavitt

(57) ABSTRACT

The exercise apparatus of the invention possesses a small footprint, thus enabling its assembly in a relatively small space. It provides in a single unitary apparatus cooperative components that enable at least 325 different positions of exercise. The apparatus includes a rigid metal frame having a box-like quadrilateral rear section detachably secured to a generally triangular front section that provides a pair of rearwardly inclined support bars on which are adjustably mounted holding elements for supporting components such as barbells. Between the quadrilateral rear section and the triangular front section, is a vertical beam having a multiplicity of vertically spaced mounting apertures, the beam functioning to support an adjustable pulley assembly from which eminates a flexible pull cable. By vertical adjustment of the pulley assembly, the pull cable may be elevated or lowered to change the angle at which a force load is imposed on the muscles of an individual using the apparatus. In conjunction with such adjustable pulley arrangement for modifying the angle of pull on the cable in relation to the user's body, there is provided a pair of telescopically adjustable foot support plates that form adjustable abutments against which the users feet may be placed. By vertically adjusting the pulley assembly and horizontally adjusting the telescopically adjustable foot plates, hundreds of different exercises may be executed.

20 Claims, 13 Drawing Sheets

U.S. PATENT DOCUMENTS 4,560,200 A 12/1985 Giannelli et al.
4,561,651 A * 12/1985 Hole ..... 482/104
4,582,318 A 4/1986 Giannelli et al.
4,632,388 A 12/1986 Schleffendorf
4,674,741 A 6/1987 Pasierb, Jr. et al.
4,691,916 A 9/1987 Voris
4,720,784 A 1/1988 Radhakrishnan et al.
4,725,056 A 2/1988 Rehri et al.
4,729,561 A * 3/1988 Desjardins ..... 482/104
4,744,560 A * 5/1988 Azari ..... 482/97
4,765,613 A 8/1988 Voris
4,775,146 A * 10/1988 Stankovic ..... 482/102
4,781,374 A * 11/1988 Lederman ..... 482/103
4,840,372 A 6/1989 Oglesby et al.
4,846,461 A 7/1989 Robards, Jr. et al.
4,907,798 A * 3/1990 Burchatz ..... 482/99
4,919,419 A * 4/1990 Houston ..... 482/138
5,011,139 A 4/1991 Towley, III
5,011,141 A 4/1991 Towley, III et al.
5,018,725 A * 5/1991 Cook ..... 482/103
5,020,794 A 6/1991 Englehardt et al.
5,042,505 A 8/1991 Mayer et al.
D321,225 S 10/1991 Solow et al.
D321,226 S 10/1991 Solow et al.
5,102,121 A 4/1992 Solow et al.
5,117,170 A 5/1992 Keane et al.
D327,719 S 7/1992 Towley, III et al.
5,205,798 A 4/1993 Lekhtman
5,213,555 A 5/1993 Hood et al.
5,238,462 A 8/1993 Cinke et al.
5,310,393 A 5/1994 Highsmith et al.
5,318,487 A 6/1994 Golen et al.
5,365,934 A 11/1994 Leon et al.
5,366,432 A 11/1994 Habing et al.
5,370,595 A 12/1994 Voris et al.
5,403,252 A 4/1995 Leon et al.
5,484,362 A 1/1996 Skowronski et al.
5,492,520 A 2/1996 Brown
5,518,477 A 5/1996 Simonson
5,577,987 A 11/1996 Brown
5,580,341 A 12/1996 Simonson
5,597,375 A 1/1997 Simonson
5,599,259 A 2/1997 Skowronski et al.
5,616,107 A 4/1997 Simonson
5,620,402 A 4/1997 Simonson
5,628,715 A 5/1997 Simonson
5,643,152 A 7/1997 Simonson
5,667,464 A 9/1997 Simonson
5,707,323 A 1/1998 Simonson
5,722,921 A 3/1998 Simonson
5,722,937 A 3/1998 Smith
5,725,459 A 3/1998 Rexach
5,741,205 A 4/1998 Doll et al.
5,752,897 A 5/1998 Skowronski et al.
5,776,040 A 7/1998 Webb et al.
5,788,614 A 8/1998 Simonson
5,788,615 A 8/1998 Jones
5,810,701 A 9/1998 Ellis et al.
5,823,920 A 10/1998 Grider
5,888,172 A 3/1999 Andrus et al.
5,899,833 A 5/1999 Ryan et al.
5,938,574 A 8/1999 Webber
5,971,896 A 10/1999 Giannelli et al.
5,989,165 A 11/1999 Giannelli et al.
5,997,447 A 12/1999 Giannelli et al.
6,004,244 A 12/1999 Simonson
6,030,322 A 2/2000 Webber
6,056,678 A 5/2000 Giannelli et al.
6,071,216 A 6/2000 Giannelli et al.
D440,609 S 4/2001 Batca et al.
6,299,568 B1 * 10/2001 Prok ..... 482/104
6,394,935 B1 * 5/2002 Lake ..... 482/94
6,447,430 B1 * 9/2002 Webb et al. ..... 482/98
6,547,704 B1 * 4/2003 Parrillo ..... 482/94
6,565,490 B1 * 5/2003 O'Hearn ..... 482/102
2002/0147086 A1 * 10/2002 Walsh ..... 482/142

FOREIGN PATENT DOCUMENTS

FR 2630652 A1 * 11/1989

OTHER PUBLICATIONS

Parabody, 814 Power Rack, 1995 catalog, p. 8.*
Cybex, Power Station 200 brochure, approximately 1996.*

* cited by examiner

Fig_11
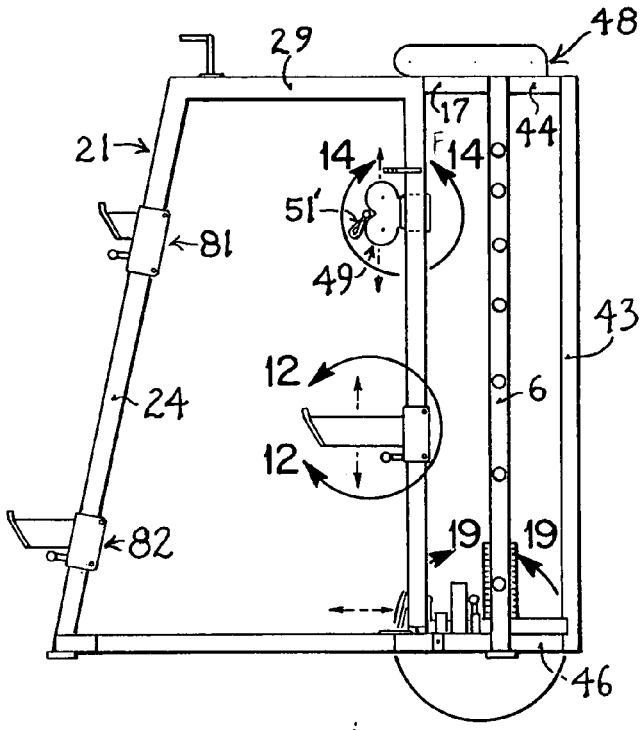
Fig_13
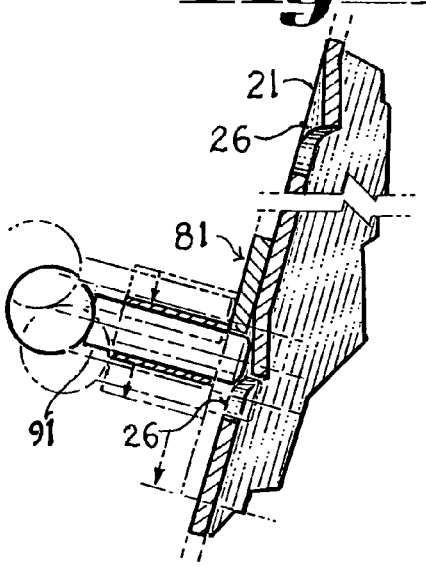
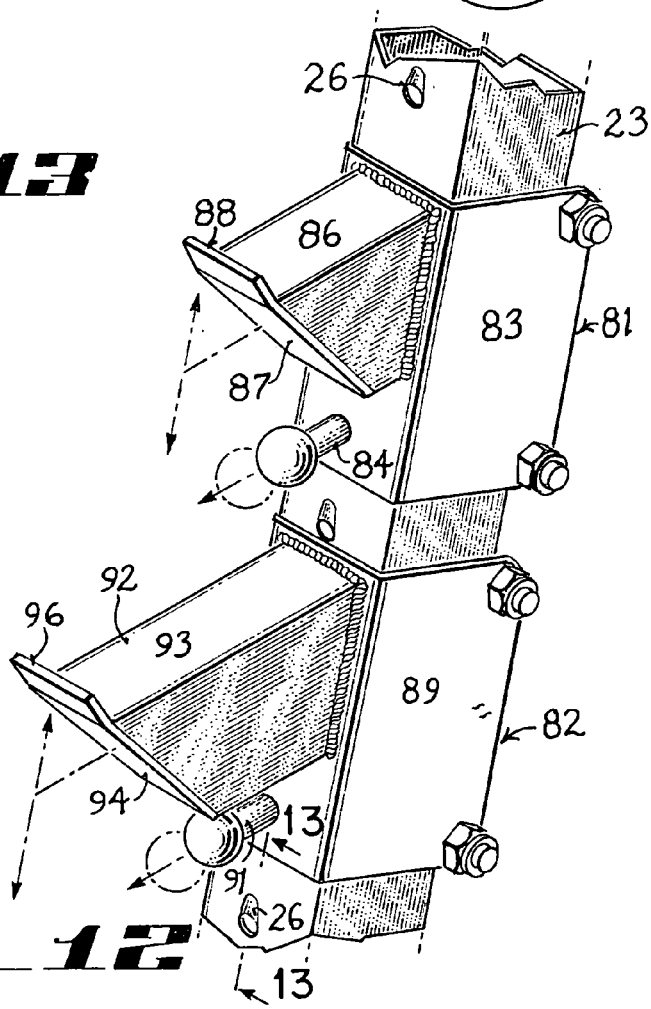
Fig_12

Fig_14
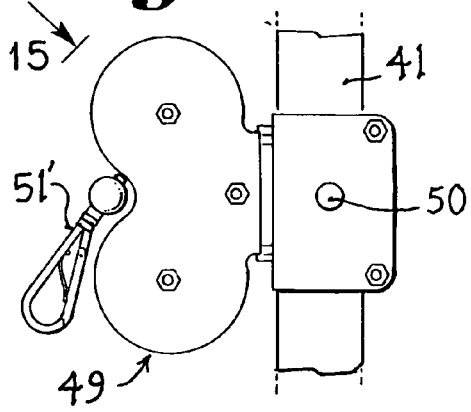
Fig_15
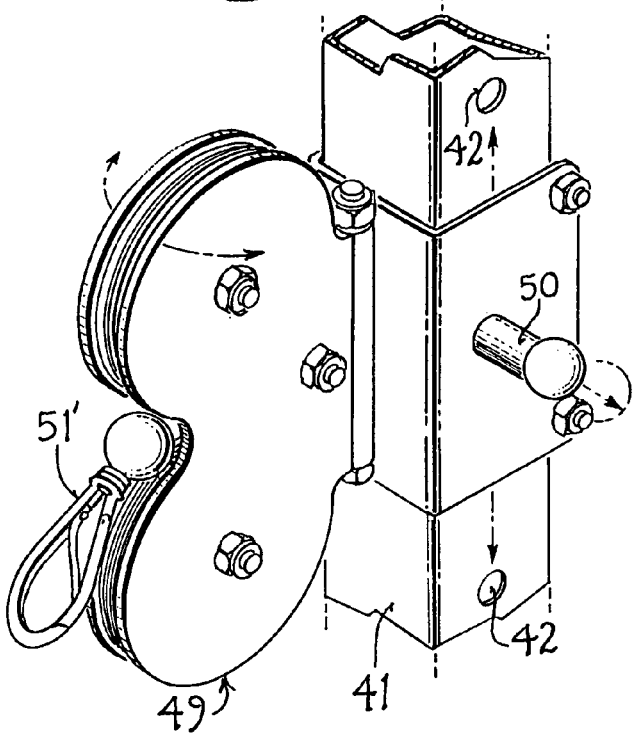
Fig_16
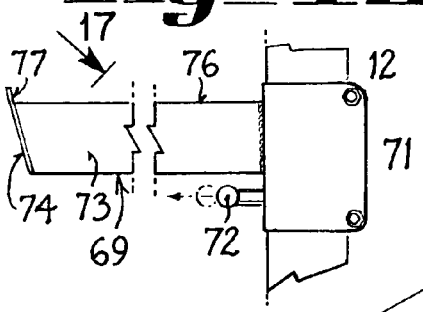
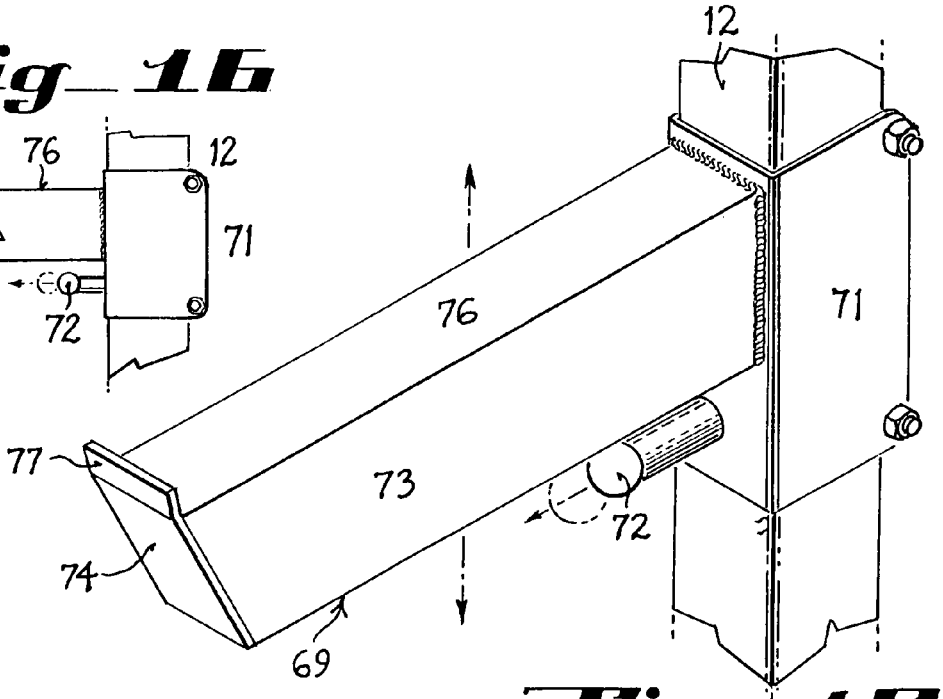
Fig_17

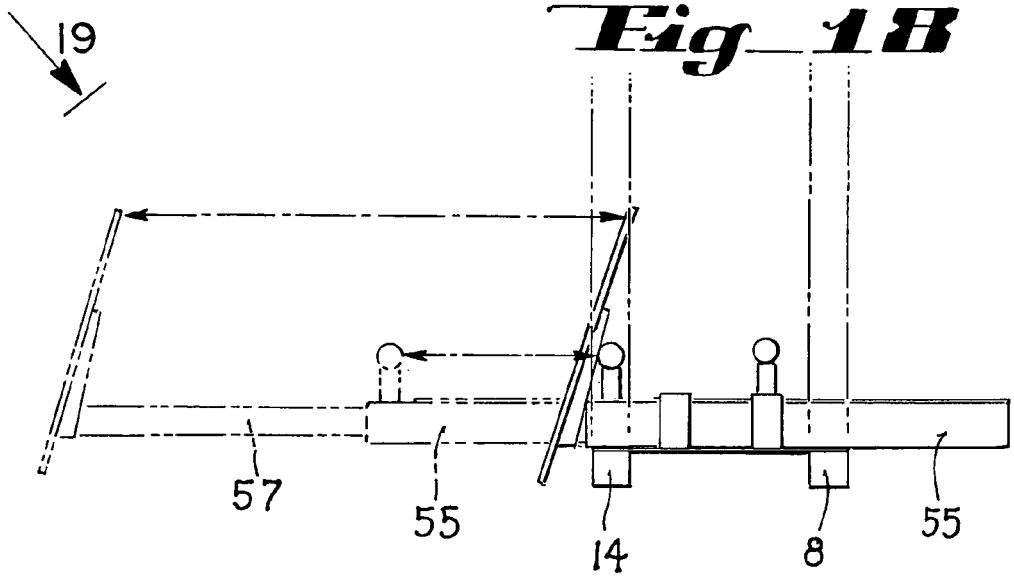
Fig_18
Fig_19
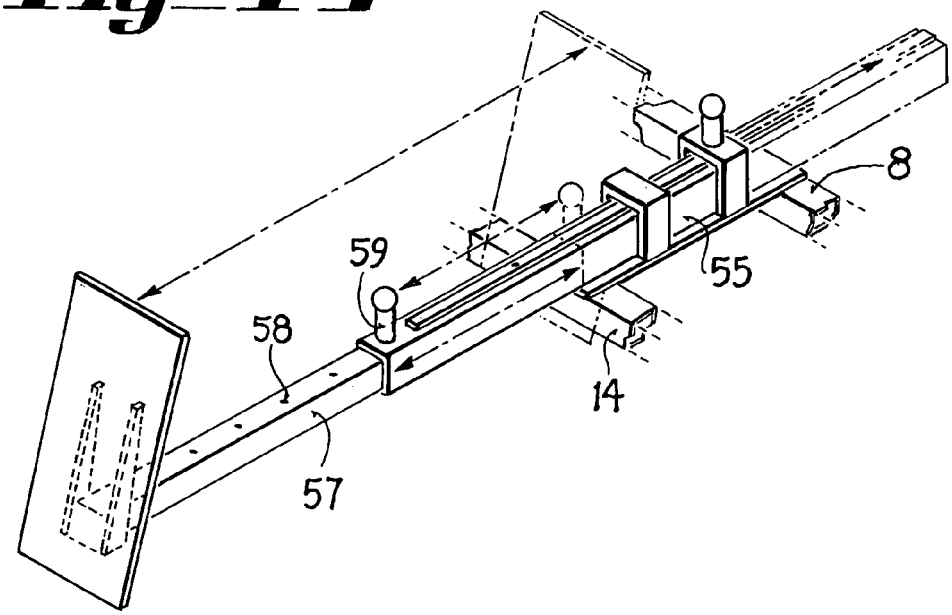

EXERCISE APPARATUS INCLUDING MULTIPLE FUNCTION ASPECTS AND SMALL FOOTPRINT

BACKGROUND OF THE INVENTION

1. Field of the Invention

The present invention relates to an exercise apparatus that encompasses a relatively small footprint in conjunction with a structure that enables the user to do many different exercises at commercial grade quality utilizing components readily available and stored on the apparatus.

2. Description of the Prior Art

The prior art is replete with many different types of structures that are, for the most part, directed to a specific form of exercise directed to the development of a specific area of the human body. Many of these prior art exercise machines have been developed to replace the traditional bench, bar, and free-weight combination. These machines provide multiple exercise stations and functionality utilizing weight stacks and a variety of non-gravity based exercise resistance components, e.g., fluid cylinders, elastic bands, centrifugal brakes and flexible bows. Machines such as these are often intended to facilitate circuit weight training (CWT).

CWT was apparently developed to promote both aerobic and muscular fitness of athletes by requiring that an athlete work varying muscle groups to the point of muscle fatigue. Aerobic conditioning is achieved by loading the cardiovascular system through maintenance of a constant moderate pace throughout and between exercises. A typical circuit may consist for example, of 8–10 exercises, each with 10–15 repetitions, performed three times and lasting a total of 30 minutes. Typically, a maximum of 30 seconds of rest between the exercises is allowed. In order to maintain such a pace, the exercise machine must have a high degree of user friendliness, i.e., the required set-up for each exercise must be simple and enable easy, smooth and rapid transitions between exercises.

The apparatus of the present invention enables a user to perform multiple exercises that are designed to exercise multiple areas of the human body. For instance, with the apparatus forming the subject matter of this invention it is possible to exercise muscles of the following muscle groups: pectorals, triceps, biceps, deltoid, trapezium, latissimus dorsi, hamstrings, glutes, quads, back, forearms, abdominal and the Psoas muscle group. The convenient exercise of these muscle groups is enabled because the exercise apparatus of this invention is designed for easy and rapid readjustment of a tension member in relation to a weight stack, easy and rapid readjustment of the amount of weight in the weight stack and incorporates gravity-based free-weight components for use apart from the weight stack and provides for safe use of such components without the need for an attendant.

Accordingly, one of the important objects of the present invention is the provision of an exercise apparatus that enables the user to readjust components cooperatively associated with the exercise apparatus in a manner to enable a user to utilize approximately 325 different exercise positions in one apparatus.

Another object of the invention is the provision of an exercise apparatus that projects a small footprint, thus enabling use of the assembled apparatus in a relatively small area of a room used for other purposes, such as a bedroom or family room.

Yet another object of the invention is the provision of an exercise apparatus that incorporates re-adjustable components movably mounted on the apparatus for vertical and horizontal adjustment and incorporating automatically actuated safety locking means when a component is readjusted from one position to another.

Still another object of the invention is the provision of an exercise apparatus incorporating an adjustable pulley attachment tethered to a weight stack and cooperable with horizontally retractable and extendable foot pedal components freely adjustable to enable 325 different exercise positions.

A still further object of the invention is the provision of an exercise apparatus incorporating integral holders for vertically supporting and storing free weight bars of different lengths and for supporting and storing the weights to be selectively mounted on the weight bars.

Yet another object of the invention is the provision of an exercise apparatus incorporating vertically inclined frame members on which may be adjustably mounted safety holders for catching a bar during bench press use.

Still another object of the invention is the provision of an exercise apparatus incorporating a primary weight stack and secondary incremental weights that may be selectively attached to the primary weight stack to vary the total weight in increments less than five pounds.

The invention possesses other objects and features of advantage, some of which, with the foregoing, will be apparent from the following description and the drawings. It is to be understood however that the invention is not limited to the embodiments illustrated and described since it may be embodied in various forms within the scope of the appended claims.

SUMMARY OF THE INVENTION

In terms of broad inclusion, the exercise apparatus forming the subject matter of this invention is distinguished in that it possesses a small footprint, thus enabling its assembly in a relatively small space or room which may be used for other purposes, and provides in a single unitary apparatus cooperative components that enable at least 325 different positions of exercise for use by the user. Broadly, the apparatus embodies a rigid metal frame having a generally box-like quadrilateral rear section detachably secured to a generally triangular front section that provides a pair of rearwardly inclined support bars on which are adjustably mounted holding elements for supporting free-standing functional exercise components such as barbells. Interposed between the quadrilateral rear section and the triangular front section, is a vertical beam having a multiplicity of vertically spaced mounting apertures, the beam functioning to support a selectively adjustable pulley assembly from which eminates a flexible pull cable. By vertical adjustment of the pulley assembly, the pull cable may be elevated or lowered to change the angle at which a force load is imposed on the muscles of an individual using the apparatus for exercise purposes while sitting on the base support surface of the apparatus. In conjunction with such adjustable pulley arrangement for modifying the angle of pull on the cable in relation to the user's body, there is provided a pair of horizontally mounted telescopically adjustable foot support plates that may be adjusted closer to or farther from the plane coincident with the vertical support beam for the pulley assembly and which form adjustable plate abutments against which the user's feet may be placed. Thus, by vertically adjusting the pulley assembly and horizontally adjusting the telescopically adjustable foot plates, the angle of the cable that runs through the pulley assembly and ultimately to the weight stack and to the proximate end of which is attached a laterally extending bar or grip component, hundreds of different back exercises may be executed, with the change from one exercise position to another being accomplished in a matter of seconds. This is important because the different positions stress the muscle groups in a slightly different manner and actually change the force load placed on a muscle group based on the angle of the cable in relation to the user. The user thus has access to hundreds of different exercise positions for the body using one apparatus having a small footprint.

BRIEF DESCRIPTION OF THE DRAWINGS

FIG. 11 is a right side elevational view in the direction of arrow 11 in FIG. 10.

FIG. 12 is a fragmentary perspective of a portion of one of the inclined beams forming the front frame section of the rigid frame.

FIG. 13 is a fragmentary sectional view illustrating the ramp for guiding a lock pin into an associated aperture.

FIG. 14 is a fragmentary elevational view of the vertically adjustable pulley block assembly shown locked to a vertical beam.

FIG. 15 is a fragmentary perspective of the pulley assembly of FIG. 14 and illustrating the digitally manipulable lock pin for locking the pulley assembly at a selected vertical height.

FIG. 16 is a side elevational view of one of the barbell catch beams slidably and adjustably mounted on a vertical frame beam.

FIG. 17 is a perspective view of the barbell catch beam shown in FIG. 16 and illustrating the manner of vertical adjustment of the catch beam.

FIG. 18 is a fragmentary side elevational view of a telescopically adjustable foot support plate assembly shown fully retracted in full lines and fully extended in broken lines.

FIG. 19 is a fragmentary perspective view of the telescopically mounted foot support plate assembly shown fully extended in full lines and fully retracted in broken lines. The view is taken in the direction of the arrow 19 in FIG. 18.

DESCRIPTION OF PREFERRED EMBODIMENT

Figure 1:
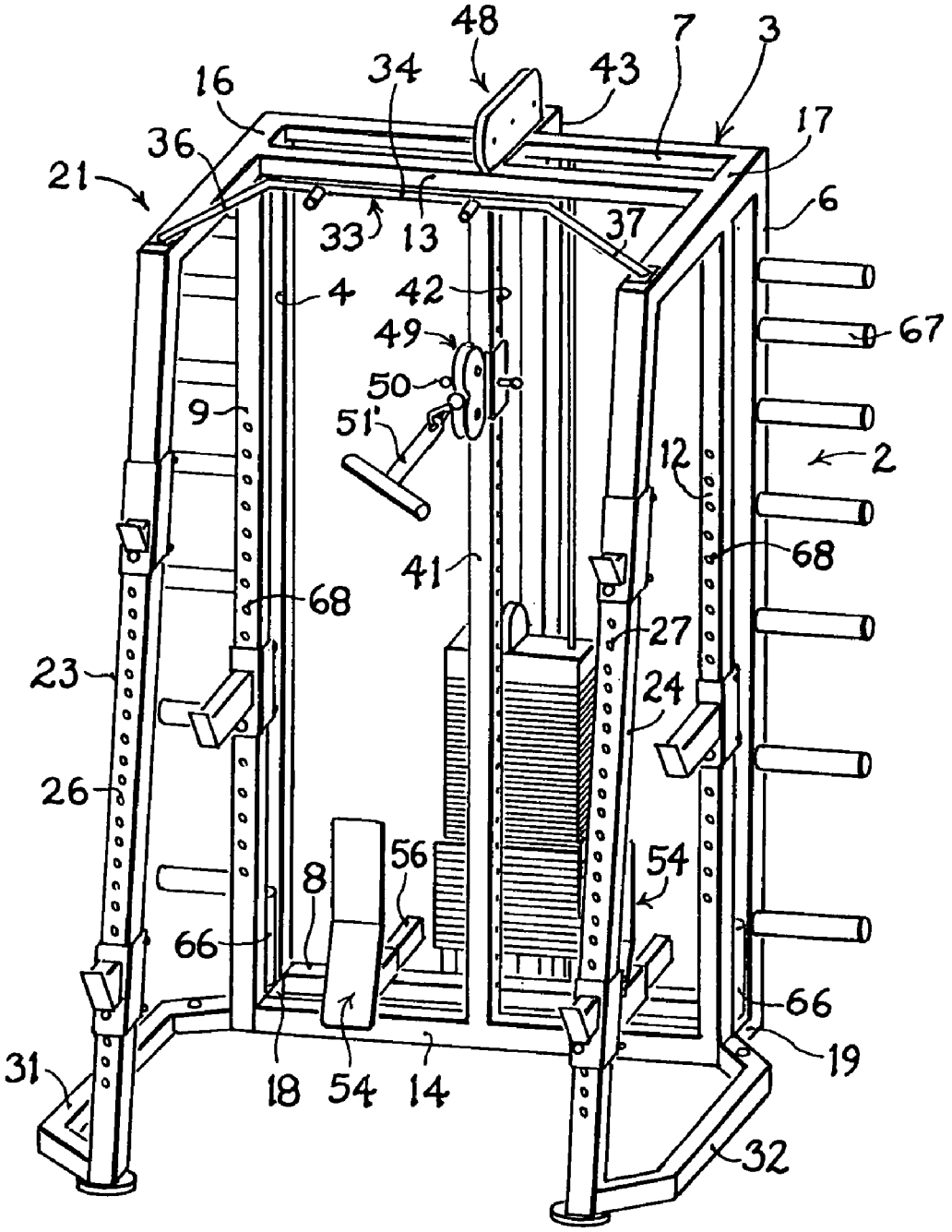
FIG. 1 is a front perspective view of the exercise apparatus of the invention.
Figure 2:
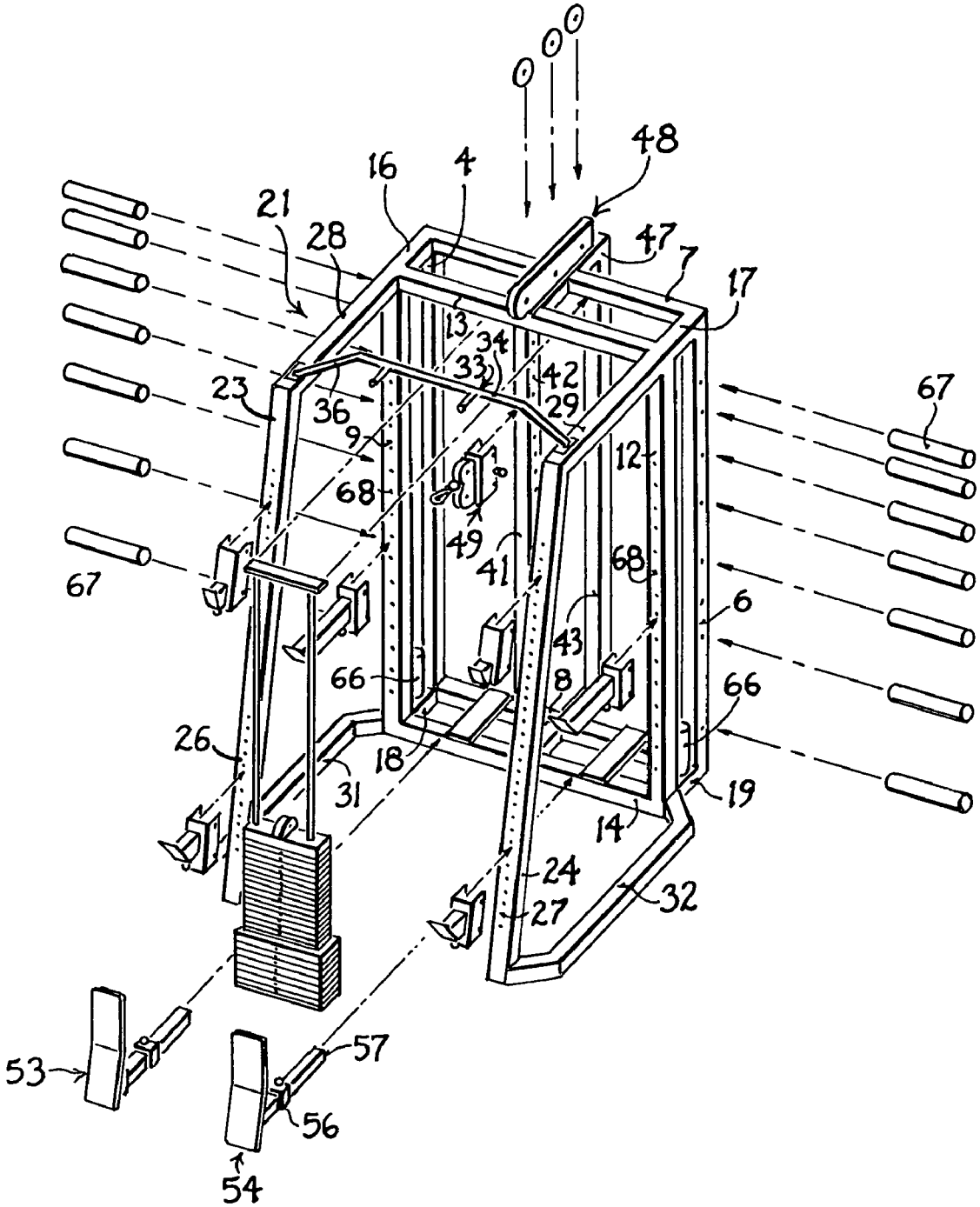
FIG. 2 is a front perspective view of the exercise apparatus shown in partially exploded form.

In terms of greater detail, and referring to the drawings, reference is made to FIGS. 1 and 2 of the drawings in which is illustrated in perspective the exercise apparatus of the invention shown in assembled form in FIG. 1 and in partially exploded form in FIG. 2. As there seen, the exercise apparatus is designated generally by the numeral 2, and includes a rear frame portion designated generally by the numeral 3 and which comprises a pair of rear laterally spaced vertical beams 4 and 6, joined at their top and bottom ends by laterally extending top and bottom beams 7 and 8, respectively. The rear frame portion 3 is generally comprised of a box-like frame section which in addition to the elements described above also includes a second front pair of laterally spaced vertical beams 9 and 12 which are also joined top and bottom by transverse beams 13 and 14, respectively. Joining the two quadrilateral frames thus formed, and retaining them in a fore-and-aft spaced relationship as shown, are short spacer beams 16 and 17 at the top of the frame and 18 and 19 at the bottom of the frame. All of these frame elements that form the generally rectangular box-like rear frame section are integrally welded so that an extremely rigid rear frame section is formed.

Detachably secured to the rear frame section thus formed is a front frame section designated generally by the numeral 21 and including a pair of laterally spaced vertically extending rearwardly inclined front beams 23 and 24, each of the front beams 23 and 24 being provided with a series of vertically spaced component mounting apertures 26 and 27, respectively, the upper peripheral edge portion of each aperture being ramped as illustrated in FIG. 13, the purpose of which is hereinafter explained. Additionally, the top end portions of the inclined beams 23 and 24 are welded to the proximate associated ends of the rearwardly extending horizontal beams 28 and 29, respectively, while the distal ends of the horizontal beams 28 and 29 are detachably secured by appropriate bracket means to the associated confronting beam 13. In like manner, the lower ends of the inclined beams 23 and 24 are welded to the proximate ends, respectively, of laterally spaced rearwardly extending horizontal base beams 31 and 32, the distal ends of both of which horizontal base beams 31 and 32 are detachably secured by appropriate bracket means to the associated lower end of the rear frame section, specifically to the vertical beams 9 and 12 and the horizontal base beam 14. Additionally, to provide lateral stability between the side frame members of the front frame portion, the upper ends of the inclined beams 23 and 24 are joined by a transversely extending exercise component designated generally by the number 33 and comprising a segmented exercise bar including a central section 34 opposite ends of which are integrally joined by corresponding laterally extending and angularly positioned end members 36 and 37, the opposite ends of which are detachably secured by appropriate brackets to the upper end portions of the inclined beams 23 and 24 and/or to the rearwardly extending beams 28 and 29 as shown.

Figure 3:
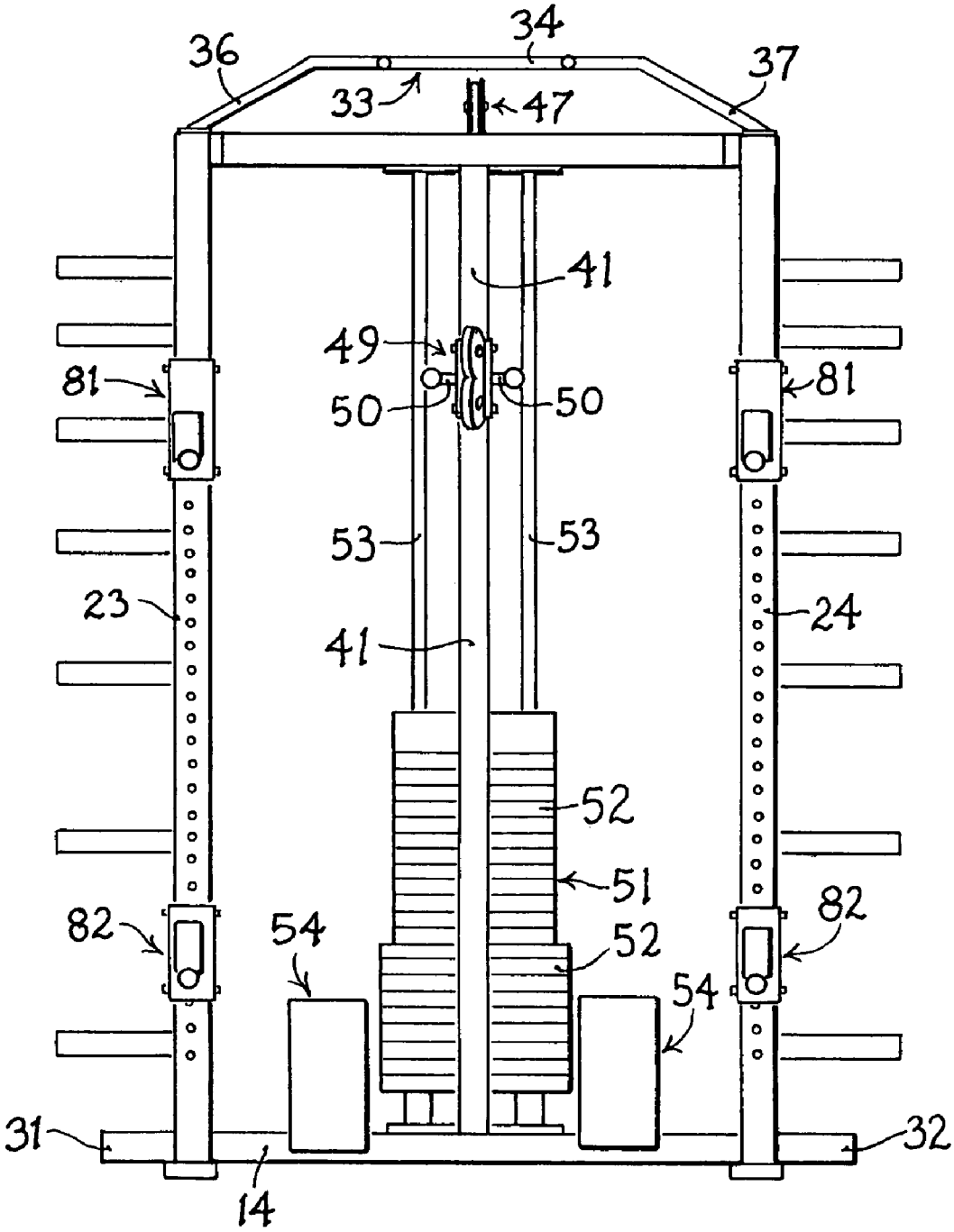
FIG. 3 is a front elevational view of the exercise apparatus.
Figure 5:
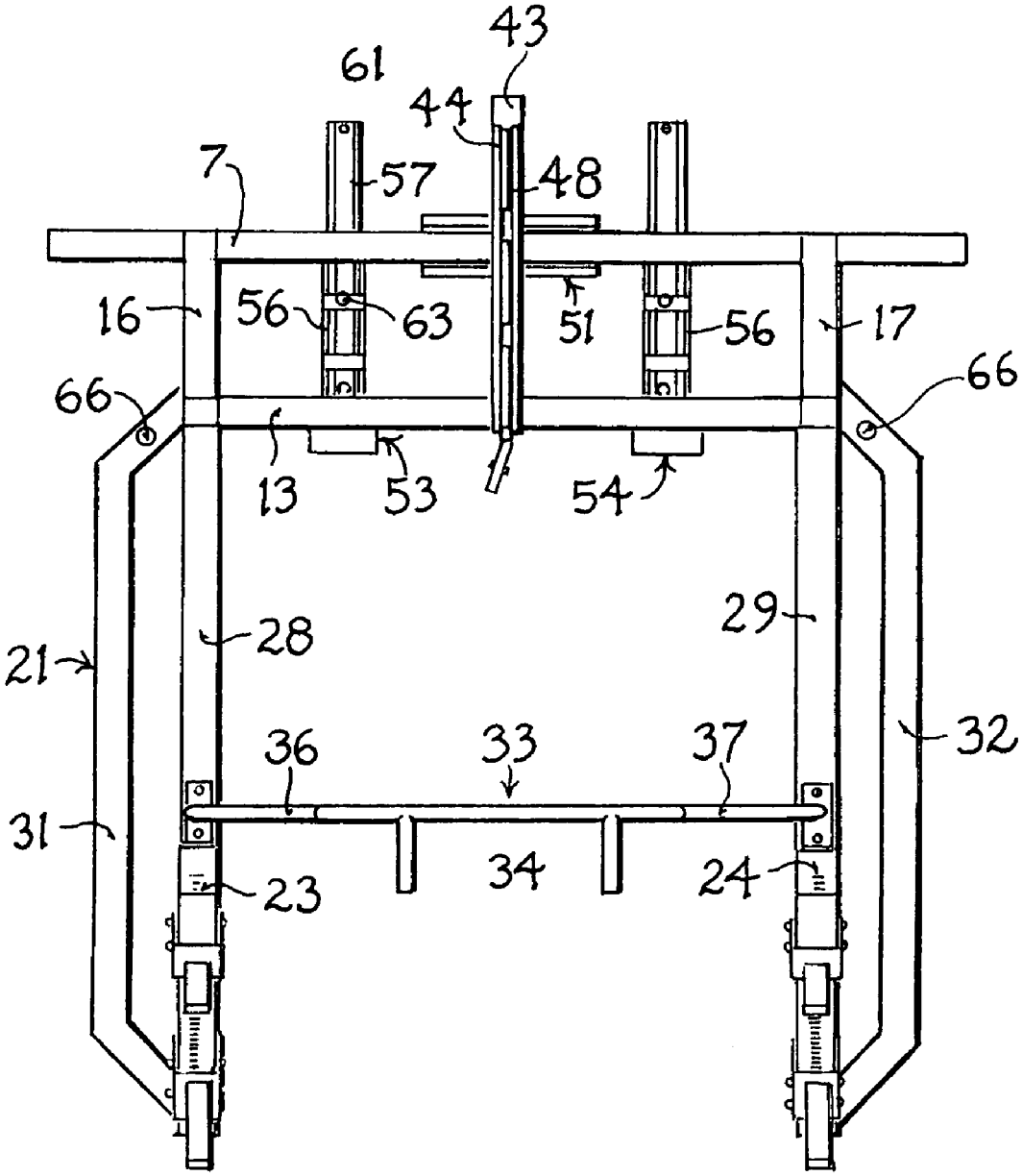
FIG. 5 is a top plan view of the exercise apparatus.
Figure 6:
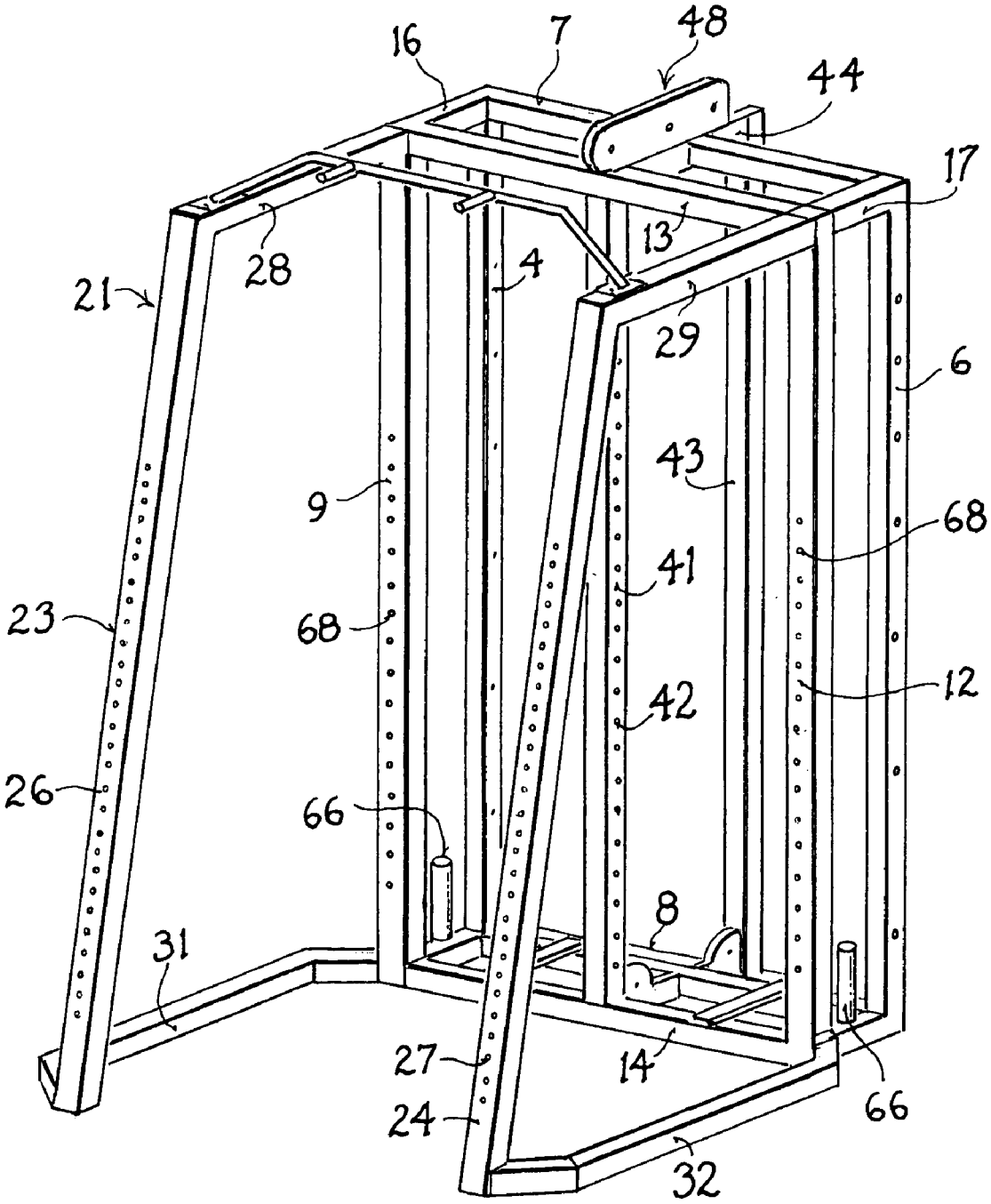
FIG. 6 is a front perspective view illustrating the supporting framework of the exercise apparatus in assembled form but devoid of exercise components.
Figure 7:
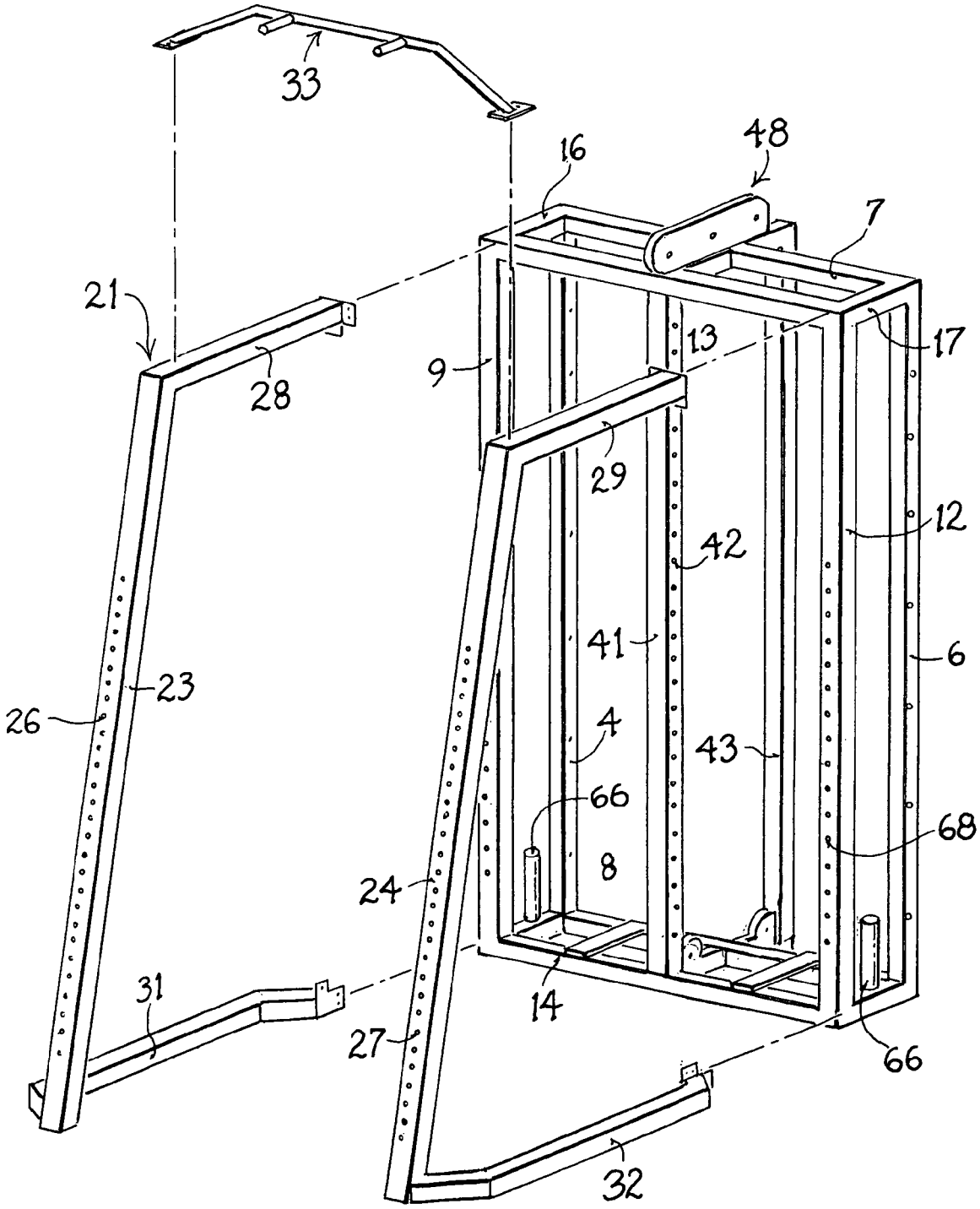
FIG. 7 is a front perspective view of the support framework shown in FIG. 6 but illustrating the framework in partially exploded form.
Figure 8:
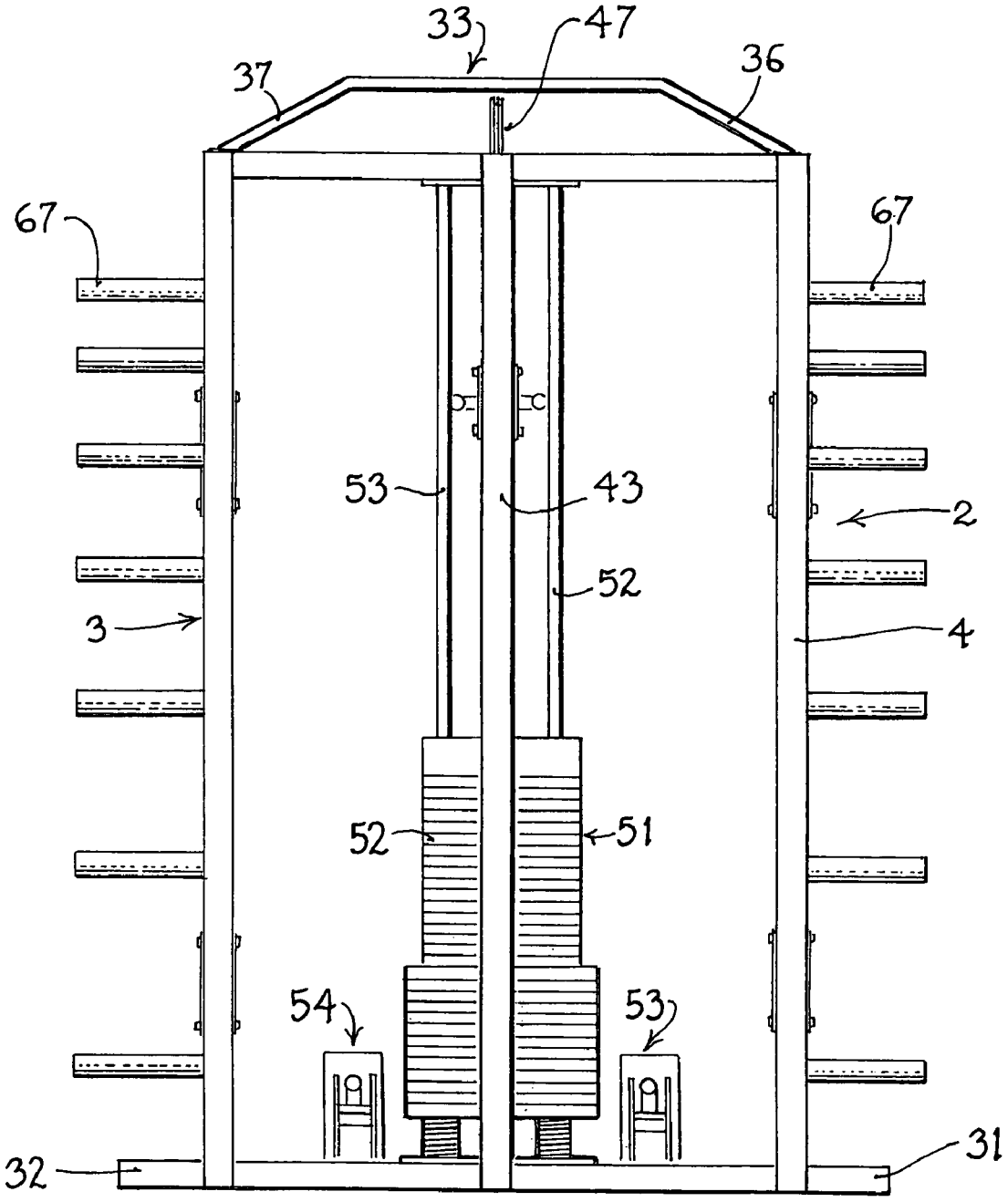
FIG. 8 is a rear elevational view of the assembled exercise apparatus.
Figure 9:
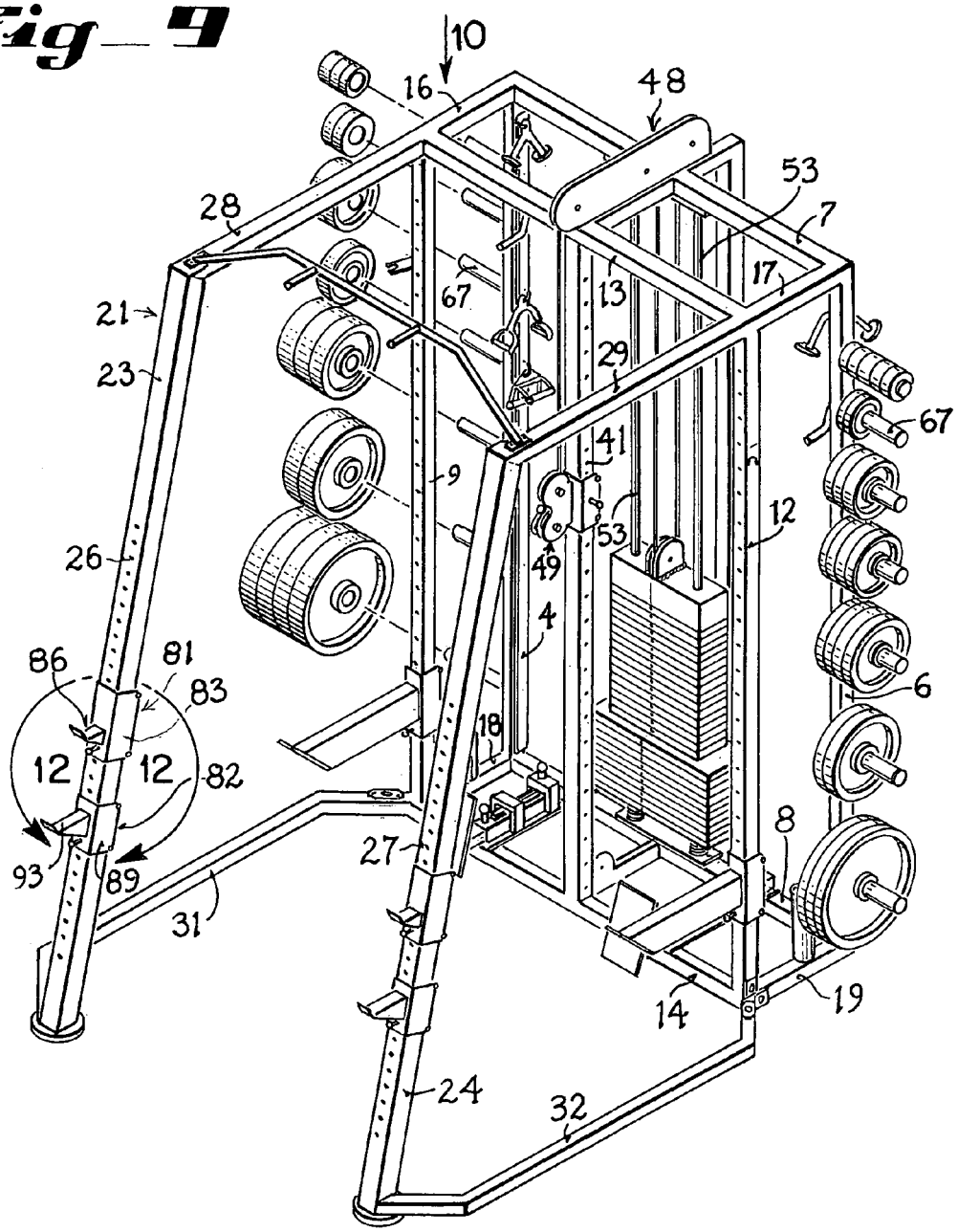
FIG. 9 is a perspective view of the exercise apparatus in assembled form resting on a support surface and with exercise components mounted thereon.
Figure 10:
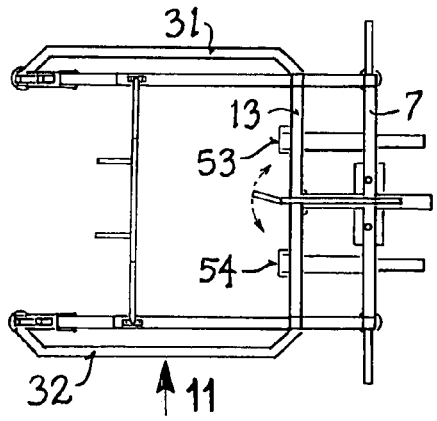
FIG. 10 is a top plan view of the exercise apparatus shown in reduced scale.
Figure 20:
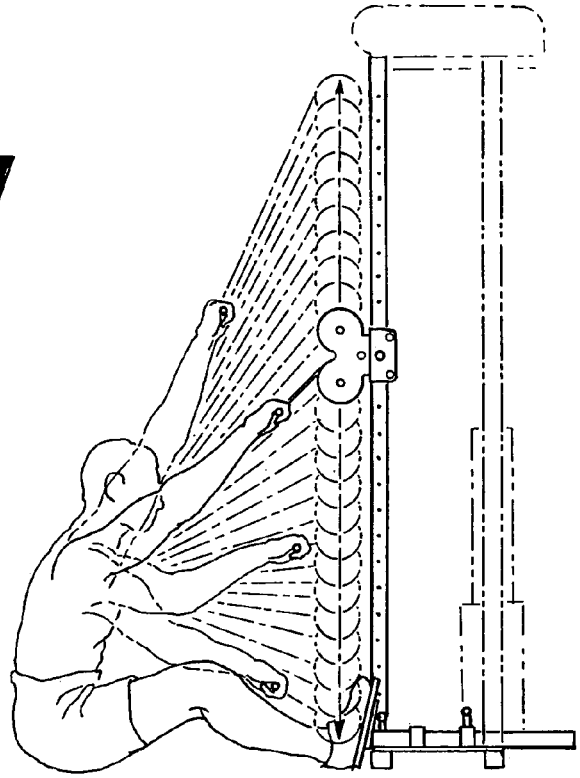
FIG. 20 is a side elevational view illustrating the twenty-five different heights to which the adjustable pulley block may be translated together with a showing of the different angles at which tension may be applied to the cable when the foot support plate assemblies are fully retracted.
Figure 21:
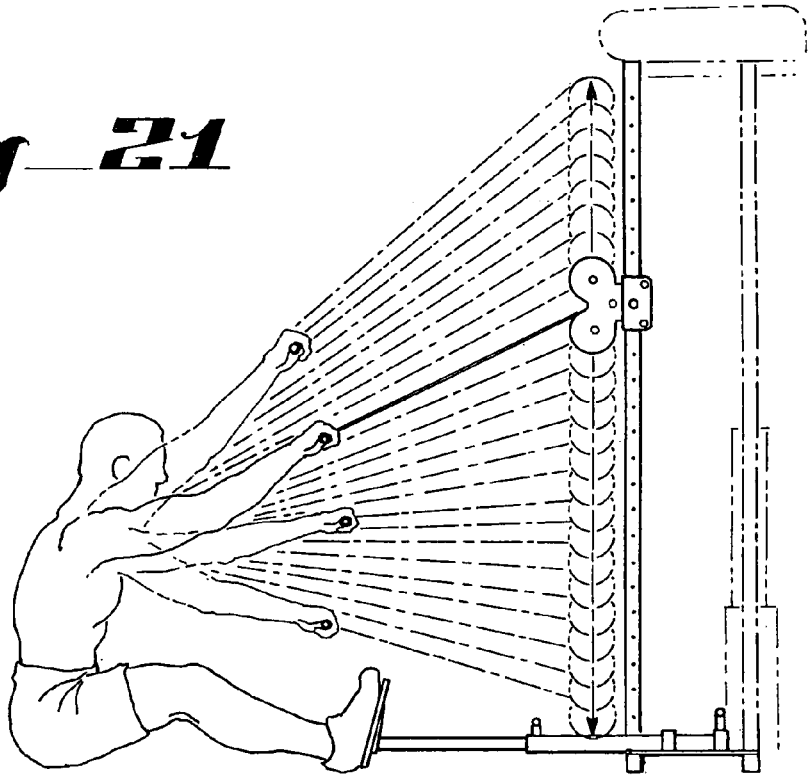
FIG. 21 is a view similar to FIG. 20 but illustrating the foot support plate assemblies fully extended so as to reduce the angularity between the cable and the person exercising to thus exercise different groups of muscles.

Continuing with a description of the exercise apparatus 2, reference is made to FIGS. 3, 5 and 6, wherein it is shown that the rear frame portion 3 of the apparatus also includes a medianly positioned vertical support beam designated generally by the numeral 41, the beam 41 being provided with a series of vertically spaced apertures 42 that penetrate from one side of the beam to the other side of the beam. The beam 41 is welded at its top end to the transverse beam 13 and at its lower end is welded to the transverse base beam 14. The medianly positioned vertical support beam 41 is spaced medianly between the two side beams 9 and 12 and lies in a plane common with the beams 9 and 12. Additionally, referring specifically to FIGS. 6 and 7, it is noted that another vertical support beam 43 is provided rearwardly of top and bottom beams 7 and 8, and is retained in this relationship by spacer beams 44 and 46, so that the beam 43 lies in a plane coincident with the vertical beam 41 but spaced rearwardly therefrom, the plane coincident with the vertical beams 41 and 43 being perpendicular to the plane coincident with the vertical support beams 9 and 12. The spacer beams 44 and 46 integrally connect the upper and lower ends of vertical beam 43 to the rear surfaces of the transverse beams 7 and 8, respectively.

The rear frame portion also includes a medianly positioned rearwardly extending spacer beam 47 disposed integrally between the laterally extending beam 13 and the parallel laterally extending beam 7. This rearwardly extending beam forms a support structure for a fixed first pulley block having multiple sheaves and designated generally by the numeral 48. An adjustable second pulley block, also having multiple sheaves, is designated generally by the numeral 49 and is adjustably mounted for selective slidable movement vertically on the vertical beam 41. Aligned locking pins 50 are provided on this adjustable pulley block that normally lock the adjustable pulley block in a selected position and which may be selectively retracted to enable the adjustable pulley block to be raised or lowered through preferably at least twenty-five different positions determined by the spacing of the series of apertures 42 with which the aligned locking pins normally automatically engage through spring action and a ramped edge portion of each aperture that guides the lock pin into the aperture. It will thus be seen that a cable 51' that "tracks" or runs through the fixed pulley block 48 and the vertically adjustable pulley block 49 and which is adapted to be grasped at its proximate end by a user, may be changed in its angle in relation to the user through at least twenty-five different angles.

Again referring to FIG. 3, it is noted that the exercise apparatus includes a weight stack designated generally by the numeral 51, the weight stack being made up of multiple superimposed individual metal weight plates 52, each preferably marked with a specific weight indicia. The weight stack is confined in the space between the rear surface of the vertical beam 41 on which the pulley block 49 is mounted, and is guided in its vertical movement by vertically extending laterally spaced guide rods 53 that extend between the lower transversely extending base beam 8 and the upper transverse beam 7. The end of the cable 51' attached to the weight stack may be relocated by the user to control the number of weight plates and thus the total weight that the user chooses to lift. It should be noted that adjustable pulley block 49 may be adjusted for the full length of the support beam 41 without creating slack in the cable, which is always taut.

To enable a user of the exercise apparatus to modify the angle of pull on the cable and thus stress the different muscle groups, the apparatus is provided with a pair of telescopically adjustable laterally spaced foot plate assemblies or abutment plates designated generally by the numeral 54 and illustrated in FIGS. 1, 2, 4, 5, 18 and 19. Referring to FIGS. 1 and 2, it will be noted that the telescopically adjustable footplate assemblies are mounted on the top surface of the laterally or transversely extending base beams 8 and 14 on opposite sides of the vertically extending beam 41 on which the adjustable pulley block 49 is slidably mounted. Each of the telescopically adjustable foot plate assemblies 54 includes an elongated tubular metal sleeve 55 having a square cross-section, conveniently slidably or otherwise adjustably superimposed on a slide bracket plate 56 that extends between the two base beams 8 and 14 and which is provided with two spaced ring extensions 56' that slidably surround the sleeve 55. A lock pin 56" is provided on one of the rings and is digitally manipulable to engage or disengage the slidable sleeve 55 through a ratcheting arrangement. The outer sleeve 55 is arranged to slidably receive a second tubular sleeve 57 that is adapted to slide within the tubular sleeve 55 between a completely retracted position and an extended or deployed for use position extending forwardly of the base beam 14.

The upper wall of the second slidable tubular sleeve 57 is provided with a series of aligned and spaced apertures 58 while the sleeve 55 is provided with a spring-pressed normally engaged lock pin 59 that engages a selected one of the spaced apertures 58 when the inner slidable sleeve is deployed but which lock pin may be selectively disengaged from the aperture in the inner sleeve to enable readjustment of the inner sleeve to place the foot plate of that assembly a selected distance forwardly from the base beam 14. When the inner slidable sleeve 57 is deployed to its outermost position (FIG. 19), an abutment disposed between the inner slidable sleeve 57 and the sleeve 55 limits the extent of projection of the inner slidable sleeve. To provide further extension of the telescopically deployable structure, a third slidable sleeve having a series of aligned apertures in its top wall may be slidably disposed within the second slidable sleeve 57. Again, a selectively actuated spring-pressed locking device may be interposed between such sleeves and actuable to incrementally limit the extent of deployment of the added sleeve in relation to the second sleeve. In general, in a preferred embodiment, this system of telescopically mounted and selectively actuable foot plate assemblies may be adjusted incrementally through numerous positions from a retracted position abutting the base plate 14 to a fully deployed position approximately two feet away from the base plate 14.

It will thus be understood that by incrementally adjusting the height of the adjustable pulley block 49 between its upper limit and its lower limit as determined by the spacing of the apertures 42 each of which is identified by a numerical indicia, and by selectively adjusting the positions of the foot plates in relation to the base beam 14, i.e., toward or away therefrom, many different incrementally increased or decreased angles of extension may be provided between the user and the axis of the cable issuing from the pulley block 49 and on which cable the user is imposing a tensive force.

While the structure described above and illustrated in the drawings is particularly useful for performing exercises that involve lifting various weights from a weight stack from whatever position the user chooses to use, it should be noted that the exercise apparatus of this invention is also capable of being used in conjunction with free-standing weights such as barbells of various weights. In this connection, the apparatus may be utilized by a user lying prone on the supporting surface that supports the exercise apparatus, or by utilizing the apparatus in conjunction with a horizontal bench press, an inclined bench press, a declining bench press, a seated military press or a behind-the-neck press, each of these and many other exercises utilizing a barbell. The apparatus is provided with appropriate retention sockets 66 for retaining the bars for barbells in an upright position for easy access, and is also provided with laterally extending support rods 67 extending cantilever fashion outwardly from the vertical beams that form a part of the rear frame section and on which weights for barbells as illustrated may be stored.

To render the exercise apparatus of the invention particularly useful for use with free-standing barbell type of weights, and the various types of exercises that are accomplished with barbells, and specifically to provide a measure of safety for the user while using barbells, and referring now to FIGS. 2, 6, 7, 11, 12, 16 and 17, it will be seen that each of the vertical upright members 9 and 12 is provided with a series of vertically spaced apertures 68. Additionally, slidably mounted on each of the vertical upright members 9 and 12 is a vertically adjustable "catch" bracket designated generally by the numeral 69, and including a body portion 71 slidably enveloping the associated vertical upright member and provided with a locking device 72 manipulable to engage or disengage an aperture 68 in the associated vertical upright members so as to lock the "catch" bracket in a selected position when the locking device 72 is engaged, and permit the "catch" bracket to be selectively slidable vertically upwardly or downwardly when the locking device is disengaged.

Formed integrally with the bracket body 71, or secured thereto by welding, and projecting forwardly therefrom, is a catch arm designated generally by the numeral 73. The catch arm constitutes a generally rectangular tubular unit forming a part of the bracket 71, and is provided with an inclined face at its distal end. Welded over the open distal end of the catch arm 73 is a face plate 74 the bottom edge of which is flush with the bottom edge of the catch arm, but which projects upwardly beyond the top surface 76 of the catch arm in a lip 77 as illustrated. The projecting lip prevents a barbell resting on the catch arms from rolling forwardly off the catch arms. It will thus be seen that while an exercise is being performed with a barbell within the footprint of the exercise apparatus, and the person exercising is unable during an exercise session to elevate the barbell to a desired height because of fatigue, all that is required to prevent injury to the user is to permit the barbell to straddle the two laterally spaced catch arms 73 and thus cause the barbell to fall on the catch arms rather than on the user's chest or neck. It should be understood that the vertical adjustability of these catch arms enables a person to exercise either lying prone on the floor, or seated on a bench, or lying prone on a bench, the elevation of the catch arms being adjusted to be at a convenient height that corresponds to the height from which the barbells will be elevated.

Figure 4:
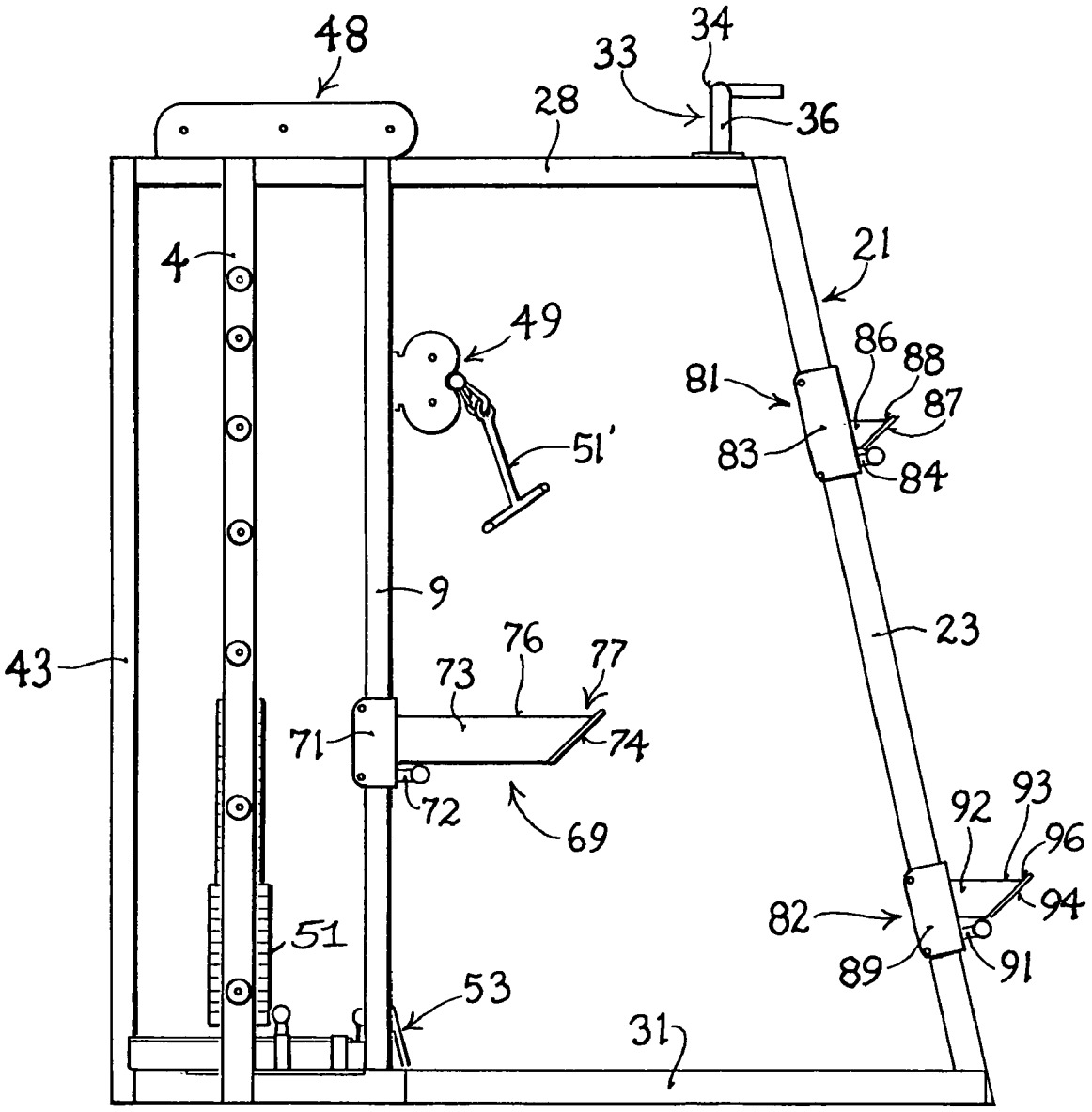
FIG. 4 is a left side elevational view of the exercise apparatus.

In like manner, and again referring to FIGS. 2, 3, 4, 6, 7, 11, 12, 16 and 17, each of the inclined support beams 23 and 24 are each provided with a pair of vertically adjustable barbell catch assemblies designated generally by the numerals 81 and 82. As illustrated in FIG. 4, the pair of barbell catch assemblies 81 are mounted higher on the associated support members 23 and 24 so as to accommodate a barbell that is being used by a person that is standing within the footprint of the exercise apparatus. On the other hand, the pair of barbell catch assemblies 82 are positioned lower on the associated inclined member for two reasons: first, they form a safety device to intercept a barbell intended to be rested on assemblies 81 if it is accidently or inadvertently dropped by the person exercising. In this regard, it is noted that such a barbell descending out of control below the assemblies 81 from the hands of the person exercising will first contact the front face of the associated support beams 23 and 24 because of the incline of these support beams, and will ultimately be intercepted by the catch arm assemblies 82.

Referring to the catch arm assemblies 81, it will be seen that each is provided with a body portion 83 that slidably envelops the associated inclined beam 23 or 24, and each is provided with a locking device 84 that may be selectively digitally manipulated to engage or disengage the slidable arm assemblies 81 from the associated support beams to enable vertical adjustment of the catch arms along the beams. Each of the catch arm assemblies also includes a forwardly projecting abutment 86 the distal end of which is provided with a flat plate 87 welded to the projecting abutment 86 and providing a lip 88 that projects beyond the upper surface of the catch arm as illustrated. As previously discussed in connection with the catch brackets 69, the projecting lip 88 prevents a barbell from rolling off of the catch arm assemblies 81 when placed thereon. It will thus be seen that if a barbell is placed on the catch arms 81 when a person exercising is fatigued, it is prevented from rolling off of the catch arms.

In like manner, the catch arm assembly 82 is provided with a body portion 89 that slidably envelops the associated beam 23 or 24, and is also provided with a lock device 91 that may be digitally manipulated to engage or disengage a selected aperture 27 formed in the face of the support beams 23 and 24. This catch arm assembly is also provided with a forwardly projecting catch arm designated generally by the numeral 92 and having an upper surface 93 intercepted by an angularly extending end plate 94 provided with a lip 96 that prevents a barbell from rolling off of the catch arm when placed thereon. It should be understood that this lower position catch arm assembly is particularly useful when a person is exercising in a prone position on his back and lifting a weighted barbell. It should also be understood that in each case where apertures are utilized to be engaged by a locking pin, a peripheral edge portion of the aperture is sloped so that the spring pressed pin will automatically engage the aperture, thus eliminating the need for the user to hunt for the aperture, thus minimizing the time and effort to complete an adjustment.

Having thus described the invention what is believed to be new and novel and sought to be protected by letters patent is as follows.

I claim:

1. An exercise apparatus having a relatively small footprint on a supporting floor area and adapted for use by a person unattended by a trainer to exercise a multiplicity of different muscle groups of the human body, said exercise apparatus compromising:

a) a rigid metal frame having top and bottom ends, said bottom end configured to partially encompass an area of the floor on which the rigid frame is supported and within which encompassed area a person may be positioned to utilize the exercise apparatus;

b) a weight stack including a multiplicity of weight plates stacked one upon another and slidably mounted on said rigid frame for elevation of a selected number of said weight plates from a predetermined lower position adjacent the bottom end of the frame to a selected higher position spaced vertically from said bottom end of the rigid frame;

c) a fixed pulley block mounted on the top end of said rigid frame and including at least one pulley rotatably journaled thereon;

d) and adjustable pulley block mounted on the rigid frame and including at least two pulleys rotatably journaled thereon, said adjustable pulley block being slidably mounted on said rigid frame for selective vertical adjustment between said top and bottom ends of said rigid frame and including means for selectively locking said adjustable pulley block at a selected height between said top and bottom ends of said rigid frame;

e) an elongated cable having one end thereof connected to said weight stack and an intermediate portion thereof engaging the rotatable pulleys in said fixed and adjustable pulley blocks and the other end of the cable remote from said weight stack connected to a handle adapted to be grasped by the person exercising so as to impose tension on said cable to elevate a selected number of said weight plates; and f) a pair of foot support plate assemblies mounted on the bottom end of said rigid frame in a position to accommodate the feet of a person sitting on the floor in said area encompassed by the bottom edge of the rigid frame and grasping the handle connected to said cable the remote end of which is connected to said weight stack.

2. The exercise apparatus according to claim 1, wherein said rigid metal frame comprises a rear frame portion and a front frame portion detachably secured to said rear frame portion to form said rigid metal frame and to enable selective assembly for use of said exercise apparatus and disassembly for packaging and shipping of said exercise apparatus.

3. The exercise apparatus according to claim 2, wherein said rear frame portion includes first and second pairs of laterally spaced vertical beams rigidly connected top and bottom by pairs of laterally extending horizontal beams and pairs of laterally separated spacer beams joining the spaced top and bottom end portions of said first and second pairs of laterally spaced vertical beams to form a generally rectangular box-like structure.

4. The exercise apparatus according to claim 3, wherein said second pair of laterally spaced vertical beams of said rear frame portion are provided with forwardly facing surfaces and the forwardly facing surfaces of the beams are provided with spaced apertures and a vertically adjustable catch bracket having a forwardly projecting catch arm is slidably mounted on each said beam of the pair and each said catch bracket includes a selectively deployable lock pin selectively digitally manipulable to unlock or lock said catch bracket to the associated beam.

5. The exercise apparatus according to claim 4, wherein the forwardly projecting catch arm of each of said catch brackets is provided with a top barbell support surface and a front face plate integrally mounted on the distal end of said catch arm to provide an upwardly extending flange projecting beyond said top barbell support surface to preclude a barbell resting on said catch arms from rolling off the catch arms.

6. The exercise apparatus according to claim 4, wherein said lock pin is provided with a spring interposed between the lock pin and the catch bracket to resiliently urge the lock pin into an associated aperture.

7. The exercise apparatus according to claim 6, wherein said spaced apertures are each provided along a peripheral edge portion with a ramp to guide said lock pin that is provided with a spring interposed between the lock pin and the vertically adjustable barbell catch assembly to resiliently urge the lock pin into an associated aperture.

8. The exercise apparatus according to claim 3, wherein laterally extending vertically spaced support rods are fixed to the laterally spaced vertical beams of said first pair of beams of said rear frame portion for storing barbell weights when not in use.

9. The exercise apparatus according to claim 2, wherein said front frame portion detachably secured to said rear frame portion comprises a pair of laterally spaced rearwardly inclined frame members spaced from said rear frame portion, a pair of upper rearwardly extending laterally spaced beams fixedly connected at corresponding ends to associated upper ends of said laterally spaced rearwardly inclined frame members and detachably connected at their opposite ends to the upper end of said rear frame portion, a pair of lower rearwardly extending laterally spaced beams fixedly connected at corresponding ends to associated lower ends of said laterally spaced rearwardly inclined frame members and detachably connected at their opposite ends to the lower end of said rear frame portion.

10. The exercise apparatus according to claim 9, wherein said pair of laterally spaced rearwardly inclined frame members spaced from said rear frame portion are each provided with corresponding vertically spaced apertures and at least one vertically adjustable barbell catch assembly is slidably mounted on each said inclined frame member and provided with a selectively deployable lock pin selectively digitally manipulable to unlock or lock said catch assembly to the associated incline frame member.

11. The exercise apparatus according to claim 10, wherein at least a pair of said vertically adjustable barbell catch assemblies is mounted on each inclined frame member.

12. The exercise apparatus according to claim 10, wherein said lock pin is provided with a spring interposed between the lock pin and the vertically adjustable barbell catch assembly to resiliently urge the lock pin into an associated aperture.

13. The exercise apparatus according to claim 12, wherein said spaced apertures are each provided along a peripheral edge with a ramp to guide said lock pin into engagement with a selected aperture.

14. The exercise apparatus according to claim 9, wherein a transversely extending exercise bar is detachably mounted on said upper rearwardly extending laterally spaced beams adjacent the connection thereof to associated upper ends of said rearwardly inclined front frame members.

15. The exercise apparatus according to claim 2, wherein said pair of foot support plate assemblies are mounted on the bottom end of said rear frame portion and are selectively adjustably deployable incrementally between a fully retracted position and an extended position spaced from said rear frame portion.

16. The exercise apparatus according to claim 15, wherein each of said foot support plate assemblies includes a first tubular sleeve fixedly mounted on said bottom end of said rear frame portion, at least one bar telescopically mounted in said tubular sleeve and on which a foot plate is mounted, and a digitally manipulable lock assembly selectively deployable to lock the foot plate at a selected distance from said rear frame member.

17. An exercise apparatus having a relatively small footprint on a supporting floor area and adapted for use by a person unattended by a trainer to exercise a multiplicity of different muscle groups of the human body, said exercise apparatus compromising:

a) a rigid metal frame having i) top and bottom ends, said bottom end configured to partially encompass an area of the floor on which the rigid frame is supported and within which encompassed area a person may be positioned to utilize the exercise apparatus, and ii) a rear frame portion and a front frame portion detachably secured to said rear frame portion to form said rigid metal frame to enable selective assembly for use of said exercise apparatus and disassembly for packaging and shipping of said exercise apparatus, wherein said rear frame portion includes first and second pairs of laterally spaced vertical beams rigidly connected top and bottom by pairs of laterally extending horizontal beams and pairs of laterally separated spacer beams joining the spaced top and bottom end portions of said first and second pairs of laterally spaced vertical beams to form a generally rectangular box-like structure and wherein said front frame portion detachably secured to said rear frame portion comprises a pair of laterally spaced rearwardly inclined frame members spaced from said rear frame portion, a pair of upper rearwardly extending laterally spaced beams fixedly connected at corresponding ends to associated upper ends of said laterally spaced rearwardly inclined frame members and detachably connected at their opposite ends to the upper end of said rear frame portion, a pair of lower rearwardly extending laterally spaced beams fixedly connected at corresponding ends to associated lower ends of said laterally spaced rearwardly inclined frame members and detachably connected at their opposite ends to the lower end of said rear frame portion;

b) a weight stack including a multiplicity of weight plates stacked one upon another and slidably mounted on said rigid frame for elevation of a selected number of said weight plates from a predetermined lower position adjacent the bottom end of the frame to a selected higher position spaced vertically from said bottom end of the rigid frame;

c) a fixed pulley block mounted on the top end of said rigid frame and including at least one pulley rotatably journaled thereon;

d) and adjustable pulley block mounted on the rigid frame and including at least two pulleys rotatably journaled thereon, said adjustable pulley block being slidably mounted on said rigid frame for selective vertical adjustment between said top and bottom ends of said rigid frame and including means for selectively locking said adjustable pulley block at a selected height between said top and bottom ends of said rigid frame;

e) an elongated cable having one end thereof connected to said weight stack and an intermediate portion thereof engaging the rotatable pulleys in said fixed and adjustable pulley blocks and the other end of the cable remote from said weight stack connected to a handle adapted to be grasped by the person exercising so as to impose tension on said cable to elevate a selected number of said weight plates; and f) a pair of foot support plate assemblies mounted on the bottom end of said rigid frame in a position to accommodate the feet of a person sitting on the floor in said area encompassed by the bottom edge of the rigid frame and grasping the handle connected to said cable the remote end of which is connected to said weight stack.

18. The exercise apparatus according to claim 17, wherein said second pair of laterally spaced vertical beams of said rear frame portion are provided with forwardly facing surfaces and the forwardly facing services of the beams are provided with spaced apertures and a vertically adjustable catch bracket having a forwardly projecting catch arm is slidably mounted on each said beam of the pair and each said catch bracket includes a selectively deployable lock pin selectively digitally manipulable to unlock or lock said catch bracket to the associated beam.

19. The exercise apparatus according to claim 17, wherein said pair of laterally spaced rearwardly inclined frame members spaced from said rear frame portion are each provided with corresponding vertically spaced apertures and at least one vertically adjustable barbell catch assembly is slidably mounted on each said inclined frame member and provided with a selectively deployable lock pin selectively digitally manipulable to unlock or lock said catch assembly to the associated incline frame member.

20. The exercise apparatus according to claim 17, wherein each of said foot support plate assemblies includes a first tubular sleeve fixedly mounted on said bottom end of said rear frame portion, at least one bar telescopically mounted in said tubular sleeve and on which a foot plate is mounted, and a digitally manipulable lock assembly selectively deployable to lock the foot plate at a selected distance from said rear frame member.

* * * * *